US010476161B2

(12) United States Patent
Yamagajo et al.

(10) Patent No.: US 10,476,161 B2
(45) Date of Patent: Nov. 12, 2019

(54) LOOP ANTENNA AND ELECTRONIC APPARATUS

(71) Applicant: FUJITSU LIMITED, Kawasaki-shi, Kanagawa (JP)

(72) Inventors: Takashi Yamagajo, Yokosuka (JP); Manabu Kai, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 15/993,676

(22) Filed: May 31, 2018

(65) Prior Publication Data

US 2018/0366827 A1 Dec. 20, 2018

(30) Foreign Application Priority Data

Jun. 15, 2017 (JP) ..... 2017-117720

(51) Int. Cl.
*H01Q 7/00* (2006.01)
*H01Q 1/38* (2006.01)

(52) U.S. Cl.
CPC ..... *H01Q 7/00* (2013.01); *H01Q 1/38* (2013.01)

(58) Field of Classification Search
CPC ..... H01Q 7/00; H01Q 1/38
See application file for complete search history.

(56) References Cited

U.S. PATENT DOCUMENTS

| | | | | |
|---|---|---|---|---|
| 5,606,259 | A | 2/1997 | Potthast et al. | |
| 6,927,737 | B2 * | 8/2005 | Inoue | H01Q 1/38 343/727 |
| 7,342,498 | B2 * | 3/2008 | Baba | G06K 19/07749 340/572.5 |
| 2005/0151690 | A1 | 7/2005 | Minemura | |
| 2011/0121080 | A1 | 5/2011 | Kai et al. | |
| 2016/0204518 | A1 * | 7/2016 | Yamagajo | H01Q 21/24 343/809 |

FOREIGN PATENT DOCUMENTS

| | | |
|---|---|---|
| JP | 07-289535 | 11/1995 |
| JP | 2005-203854 | 7/2005 |
| JP | 2008-092259 | 4/2008 |
| JP | 2011-109552 | 6/2011 |

* cited by examiner

*Primary Examiner* — Hoang V Nguyen
(74) *Attorney, Agent, or Firm* — Fujitsu Patent Center

(57) ABSTRACT

A loop antenna includes: a substrate; a feeding element including a first portion and a second portion which are provided on a first surface of the substrate, have electrical conductivity, are fed with electric power from a feeding point, the first portion extending from the feeding point in a first direction, the second portion extending from the feeding point in a second direction; and an emitting element which has electrical conductivity, is formed in a loop shape in such a manner that the emitting element surrounds the substrate along a surface perpendicular to the first surface, and includes a first end provided so as to electromagnetically couple to the first portion on the first surface and a second end provided so as to electromagnetically couple to the second portion on the first surface, a gap being disposed between the first end and the second end.

11 Claims, 14 Drawing Sheets

LOOP ANTENNA AND ELECTRONIC APPARATUS

CROSS-REFERENCE TO RELATED APPLICATION

This application is based upon and claims the benefit of priority of the prior Japanese Patent Application No. 2017-117720, filed on Jun. 15, 2017, the entire contents of which are incorporated herein by reference.

FIELD

The embodiments discussed herein are related to a loop antenna and an electronic apparatus.

BACKGROUND

Loop antennas are used in various applications.

Related art is disclosed in Japanese Laid-open Patent Publication No. 2011-109552.

SUMMARY

According to an aspect of the embodiments, a loop antenna includes: a substrate; a feeding element including a first portion and a second portion which are provided on a first surface of the substrate, have electrical conductivity, are fed with electric power from a feeding point, the first portion extending from the feeding point in a first direction, the second portion extending from the feeding point in a second direction; and an emitting element which has electrical conductivity, is formed in a loop shape in such a manner that the emitting element surrounds the substrate along a surface perpendicular to the first surface, and includes a first end provided so as to electromagnetically couple to the first portion of the feeding element on the first surface and a second end provided so as to electromagnetically couple to the second portion of the feeding element on the first surface, a gap being disposed between the first end and the second end.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

For example, in an environment in which a loop antenna is disposed near a conductor, the emission characteristics and so on of the loop antenna may change, so that desired emission characteristics may not be obtained. For that reason, for example, loop antennas used for wireless tags and having stable performance in a state of being attached to metal are provided.

In such a loop antenna, a first conductor forms a first curved surface and includes a third terminal coupled to a first terminal of a wireless communication circuit at a first end in the first curved surface and a first area at a second end opposite to the first end in the first curved surface. A second conductor forms a second curved surface and includes a fourth terminal coupled to a second terminal of the wireless communication circuit at a third end in the second curved surface and a second area at a fourth end opposite to the third end in the second curved surface. The first area and the second area overlap in parallel with each other, and the first curved surface and the second curved surface form the loop antenna.

For example, an object to which the loop antenna is mounted is not limited to a metal object but may be a dielectric. For that reason, the antenna characteristics may be maintained regardless of an installation location of the loop antenna.

For example, a loop antenna in which degradation of antenna characteristics due to a difference in installation environment may be suppressed may be provided.

Loop antennas have a linear feeding element disposed on a first surface of a substrate and an emitting element whose both ends are positioned on the first surface of the substrate and are formed in a loop shape on a surface perpendicular to the first surface of the substrate. The emitting element and the feeding element are disposed so that one end side of the emitting element and one end side of the feeding element are electromagnetically coupled together via a gap, and the other end side of the emitting element and the other end side of the feeding element are electromagnetically coupled together via a gap. Thus, the emitting element is fed with power from the feeding element due to the electromagnetic coupling between the emitting element and the feeding element. In the loop antenna, the degree of electromagnetic coupling between the emitting element and the feeding element is adjusted so that the difference in antenna characteristics due to the difference in installation environment is suppressed.

Figure 1A:
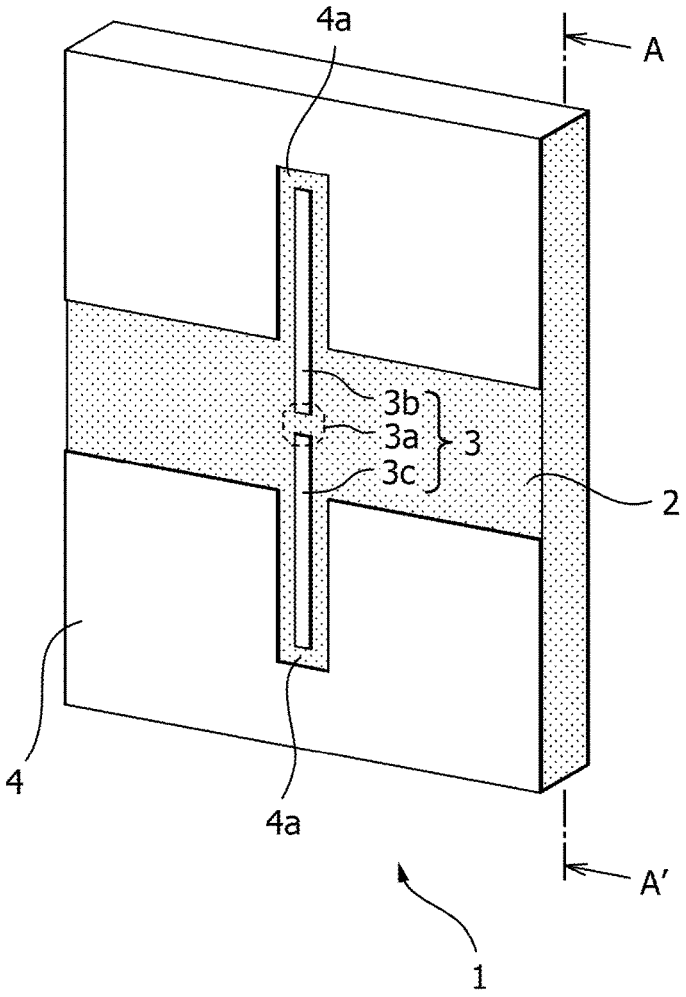
FIG. 1A illustrates an example of a perspective view of a loop antenna.
Figure 1B:
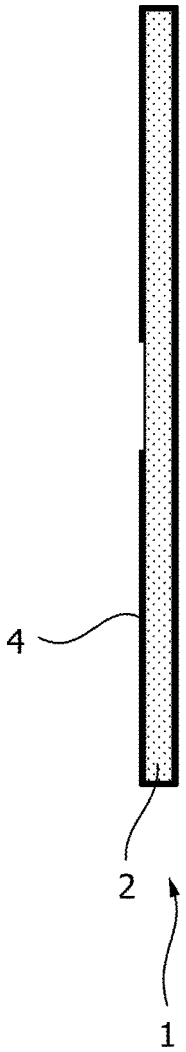
FIG. 1B illustrates an example of a side view of the loop antenna viewed from the direction of arrow A-A'.

FIG. 1A illustrates an example of a perspective view of the loop antenna. FIG. 1B illustrates an example of a side view of the loop antenna illustrated in FIG. 1A viewed from the direction of arrow A-A'.

The loop antenna 1 includes a substrate 2, a feeding element 3, and an emitting element 4.

The substrate 2 is formed like a rectangular plate with a dielectric material, for example, synthetic resin, such as an acrylonitrile-butadiene-styrene (ABS) resin, a polyethylene terephthalate (PET) resin, or a polycarbonate resin. On one surface of the substrate 2, for example, a signal processing circuit for wireless communication using the loop antenna 1 and so on are provided.

The feeding element 3 is formed in a straight line with a conductor, such as copper or gold. The feeding element 3 is disposed on the surface (a first surface) of the substrate 2 on which the signal processing circuit for wireless communication using the loop antenna 1 is disposed. The surface of the substrate 2 on which the feeding element 3 is disposed is hereinafter referred to as "front surface of the substrate 2", and a surface of the substrate 2 opposite to the front surface is referred to as "back surface" for convenience of description. The feeding element 3 is fed with power at a feeding point 3*a* disposed at the middle point, like a dipole antenna. The feeding element 3 includes a first portion 3*b* extending from the feeding point 3*a* in a direction toward a first end side of the substrate 2 (for example, a first direction) and a second portion 3*c* extending from the feeding point 3*a* in a direction toward a second end side of the substrate 2 opposite to the first end (for example, a second direction). The length of the first portion 3*b* and the length of the second portion 3*c* are preferably equal to each other so that the emission pattern of the loop antenna 1 in the longitudinal direction of the feeding element 3 is symmetrical about the direction of the normal to the front surface of the substrate 2.

The sum of the lengths of the first portion 3*b* and the second portion 3*c* of the feeding element 3, for example, the length of the feeding element 3 in the longitudinal direction, is preferably shorter than one half of the electrical length of a design wavelength corresponding to the operating frequency of the loop antenna 1 (hereinafter simply referred to as "design wavelength"). This causes the directions of electric currents flowing across the entire feeding element 3 to be substantially the same, and therefore the directions of electric currents at both ends of the emitting element 4 to be also substantially the same. This allows radio waves emitted from each of both ends of the emitting element 4 provided on the front surface of the substrate 2 to intensify each other, resulting in an increase in the operation gain of the loop antenna 1.

The emitting element 4 is shaped like a plate with a conductor, such as copper or gold. For example, the emitting element 4 is formed in a loop shape so as to surround the substrate 2 along the longitudinal direction of the feeding element 3 on a surface perpendicular to the front surface of the substrate 2. Both ends of the emitting element 4 face each other on the front surface of the substrate 2 and are disposed at an interval at a degree not to be electromagnetically coupled to each other. The length of the loop along the longitudinal direction of the feeding element 3, formed of the emitting element 4, is substantially equal to the electrical length of the design wavelength. Depending on the desired specification, the length of the loop formed of the emitting element 4 may differ from the electrical length of the design wavelength.

The emitting element 4 has a predetermined width along a direction intersecting the surface on which the loop is formed, for example, the crosswise direction of the feeding element 3. Therefore, the emitting element 4 has a three-dimensional shape. The operation gain of the loop antenna 1 changes according to the width of the emitting element 4 in the crosswise direction of the feeding element 3.

The emitting element 4 has slits 4*a*, at both ends, along the longitudinal direction of the feeding element 3, respectively. The two slits 4*a* each accommodate one end of the feeding element 3, with a gap through which the feeding element 3 and the emitting element 4 can be electromagnetically coupled. This allows the emitting element 4 to be fed with power at each of both end sides thereof from the feeding element 3. The emitting element 4 radiates or receives radio waves.

The capacitive component of the loop antenna 1 changes according to the length of the portion of the feeding element 3 inserted in each slit 4*a* and the width of the gap between the feeding element 3 and the emitting element 4. For example, the capacitive component of the loop antenna 1 increases as the portion of the feeding element 3 inserted in each slit 4*a* increases or the gap between the feeding element 3 and the emitting element 4 in each slit 4*a* decreases. Accordingly, the impedance of the loop antenna 1 may be adjusted by adjusting the length of the portion of the feeding element 3 inserted in each slit 4*a* and the width of the gap between the feeding element 3 and the emitting element 4.

Figure 2A:
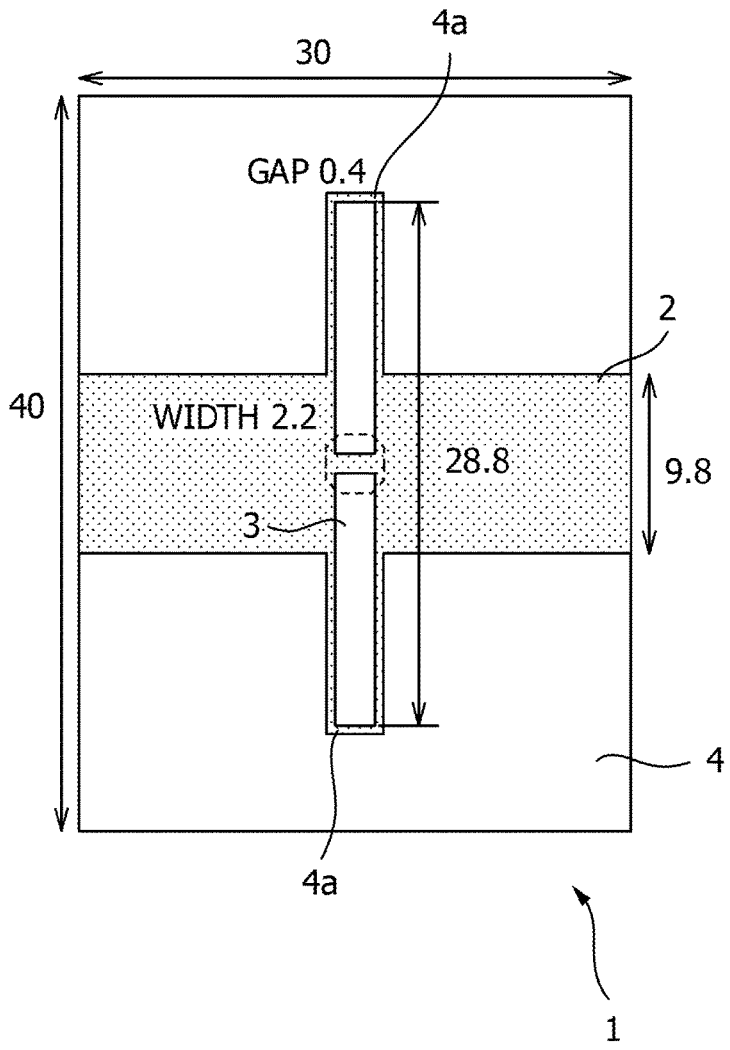
FIG. 2A illustrates an example of a plan view of the loop antenna illustrating dimensions of parts used in an electromagnetic field simulation of the emission characteristics thereof.
Figure 2B:
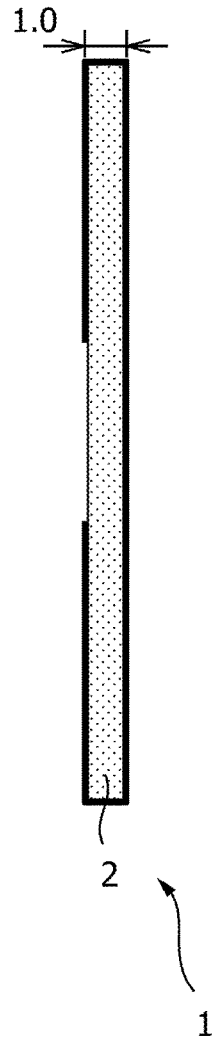
FIG. 2B illustrates an example of a side view of the loop antenna illustrating the dimensions of the parts used in the electromagnetic field simulation of the emission characteristics thereof.

FIG. 2A illustrates an example of a plan view of a loop antenna 1 illustrating the dimensions of parts used in an electromagnetic field simulation of the emission characteristics thereof. FIG. 2B illustrates an example of a side view of the loop antenna 1 illustrating the dimensions of the parts used in the electromagnetic field simulation of the emission characteristics thereof. In the simulation, the operating frequency of the loop antenna 1 was 2.45 GHz. The relative dielectric constant $\varepsilon r$ of the substrate 2 was set to 4.0, and the dielectric dissipation factor tangent tan $\delta$ of the substrate 2 was set to 0.02. Further, the conductivity of the feeding element 3 and the emitting element 4 was set to $5\times10^7$ [S/m].

The length of the substrate 2 along the longitudinal direction of the feeding element 3 was set to 40 mm, and the thickness of the substrate 2 was set to 1 mm. The length of the feeding element 3 in the longitudinal direction was set to 28.8 mm, and the length of the feeding element 3 in the crosswise direction, that is, the width, was set to 2.2 mm. The width of the emitting element 4 along the crosswise direction of the feeding element 3 was set to 30 mm, and the distance between both ends of the emitting element 4 was set to 9.8 mm. The length of each of the two slits 4*a* was set to 14.9 mm, and the width was set to 3 mm. For example, the gap between the feeding element 3 and the emitting element 4 in each slit 4*a* was set to 0.4 mm.

Figure 3A:
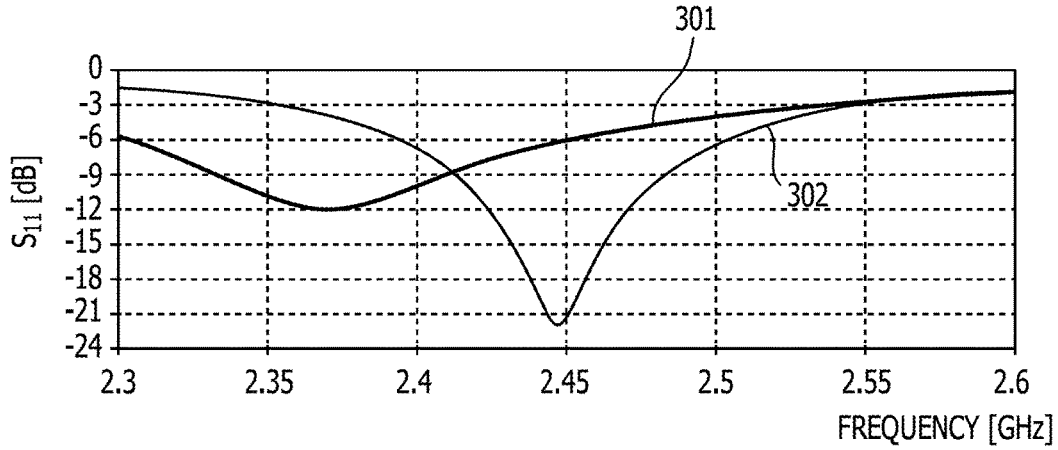
FIG. 3A illustrates an example of the frequency response of the $S_{11}$ parameter of the loop antenna.
Figure 3B:
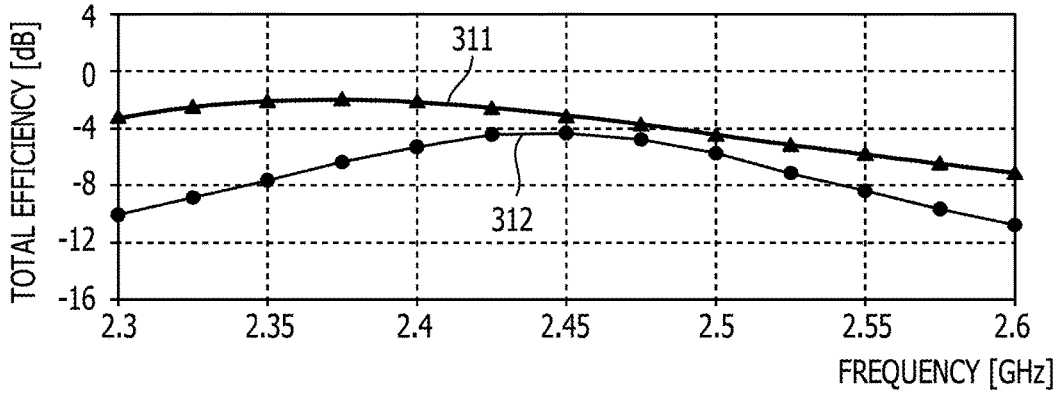
FIG. 3B illustrates an example of the frequency response of the total efficiency of the loop antenna.
Figure 3C:
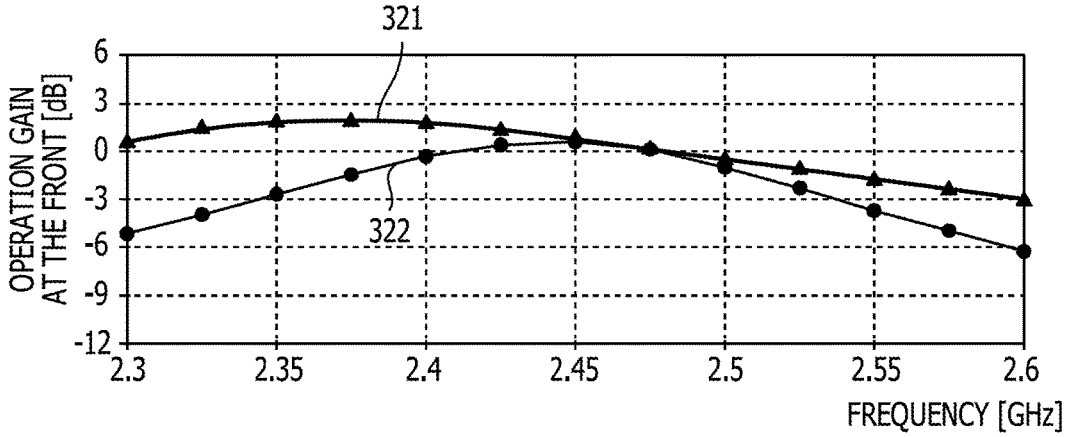
FIG. 3C illustrates an example of the frequency response of the operation gain of the loop antenna.

FIG. 3A illustrates an example of the frequency response of the $S_{11}$ parameter (return loss) of the loop antenna 1, obtained by the electromagnetic field simulation. FIG. 3B illustrates an example of the frequency response of the total efficiency of the loop antenna 1, obtained by the electromagnetic field simulation. FIG. 3C illustrates an example of the frequency response of the operation gain of the loop antenna 1 in the direction of the normal to the front surface (hereinafter referred to as "front direction") of the substrate 2, obtained by the electromagnetic field simulation. In FIGS. 3A to 3C, the horizontal axes indicate frequencies. In FIG. 3A, the vertical axis indicates $S_{11}$ parameter. In FIG. 3B, the vertical axis indicates total efficiency. In FIG. 3C, the vertical axis indicates operation gain.

In FIG. 3A, graph 301 illustrates the frequency response of the $S_{11}$ parameter of the loop antenna 1 in the case where the loop antenna 1 is disposed in the air. Graph 302 illustrates the frequency response of the $S_{11}$ parameter of the loop antenna 1 in the case where the loop antenna 1 is disposed in contact with a metal plate on the back side of the substrate 2. As illustrated in graph 301 and graph 302, the $S_{11}$ parameter is less than −6 dB at an operating frequency of 2.45 GHz in any of the case where the loop antenna 1 is disposed in the air and the case where the loop antenna 1 is disposed on metal.

In FIG. 3B, the graph 311 illustrates the frequency response of the total efficiency of the loop antenna 1 in the case where the loop antenna 1 is disposed in the air. Graph 312 illustrates the frequency response of the total efficiency of the loop antenna 1 in the case where the loop antenna 1 is disposed in contact with a metal plate on the back side of the substrate 2. As illustrated in graph 311 and graph 312, the difference in total efficiency between the case where the loop antenna 1 is disposed in the air and the case where the loop antenna 1 is disposed on metal is suppressed to about 1 dB at an operating frequency of 2.45 GHz.

In FIG. 3C, graph 321 illustrates the frequency response of the operation gain at the front direction of the loop antenna 1 in the case where the loop antenna 1 is disposed in the air. Graph 322 illustrates the frequency response of the operation gain at the front of the loop antenna 1 in the case where the loop antenna 1 is disposed in contact with a metal plate on the back side of the substrate 2. As illustrated in graph 321 and graph 322, the operation gain at the front direction when the loop antenna 1 is disposed in the air and the operation gain at the front direction when the loop antenna 1 is disposed on metal are substantially equal at an operating frequency of 2.45 GHz.

Figure 4:
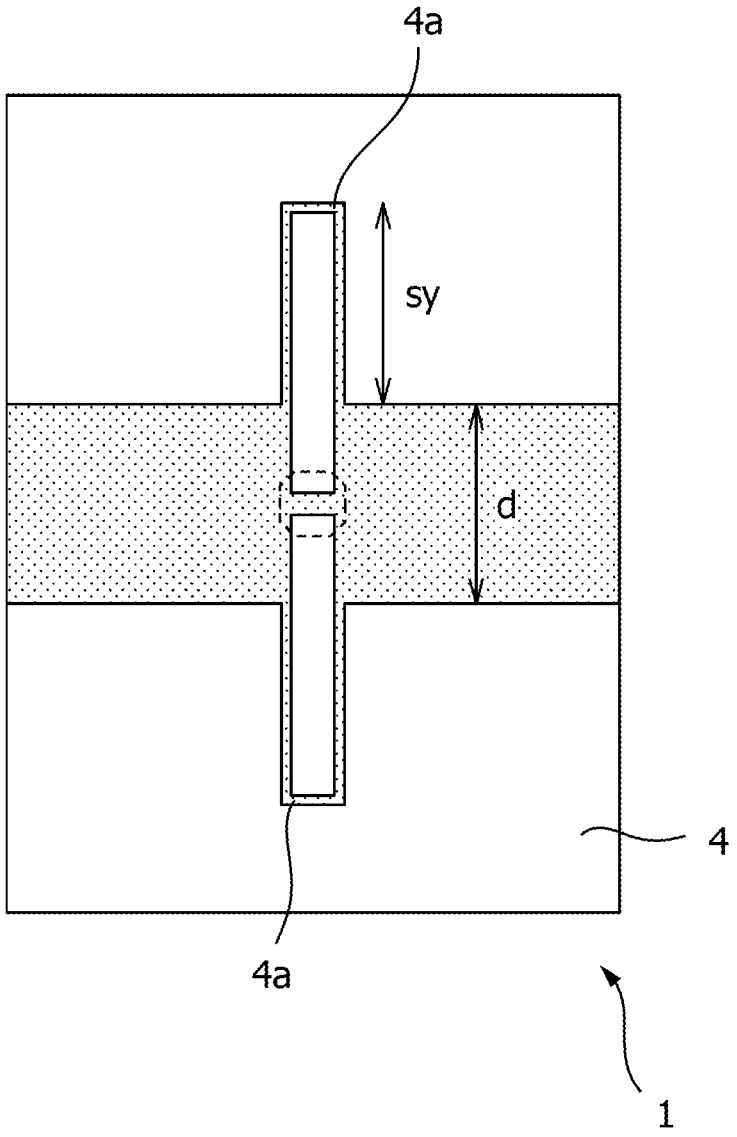
FIG. 4 illustrates an example of a plan view of a loop antenna to be adjusted illustrating the dimensions thereof.

FIG. 4 illustrates an example of a plan view of the loop antenna 1 to be adjusted illustrating the dimensions thereof. As illustrated in FIG. 4, the influence of the loop antenna 1 on the antenna characteristics when the length sy of each slit 4*a* formed in the emitting element 4 of the loop antenna 1 or the distance d between both ends of the emitting element 4 is changed was examined by performing an electromagnetic field simulation. In this electromagnetic field simulation, the electrical properties of the substrate 2, the feeding element 3, and the emitting element 4 and the dimensions of the parts of the loop antenna 1 other than the length sy of each slit 4*a* and the distance d between both ends of the emitting element 4 may be the same as the electrical properties and dimensions illustrated in FIG. 2A and FIG. 2B.

Figure 5A:
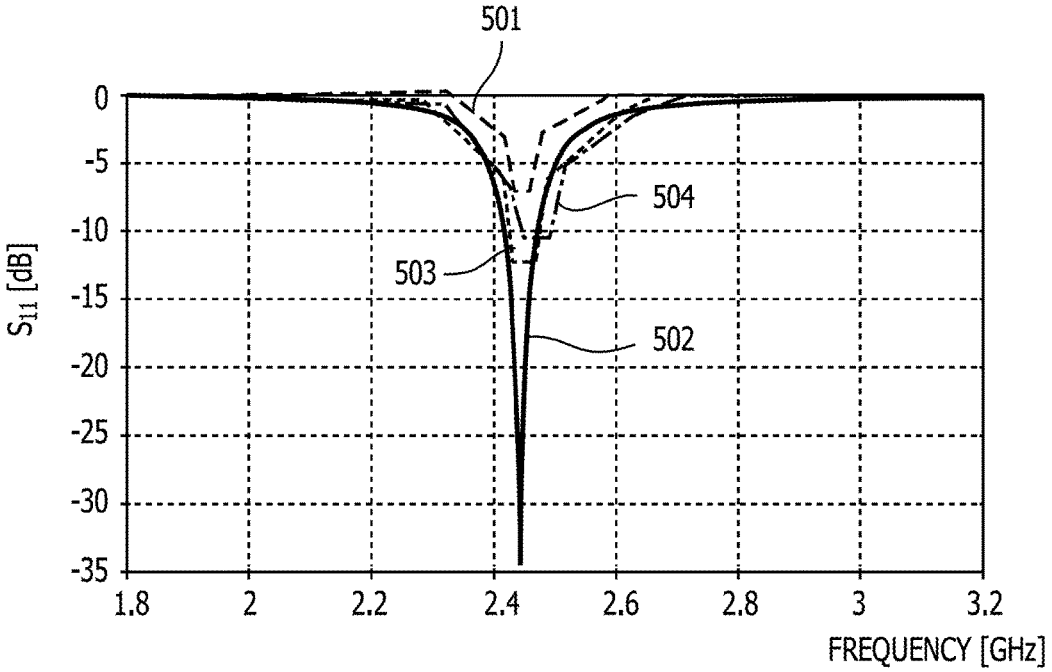
FIG. 5A illustrates an example of the frequency response of the $S_{11}$ parameter of the loop antenna when the length of each slit is changed.
Figure 5B:
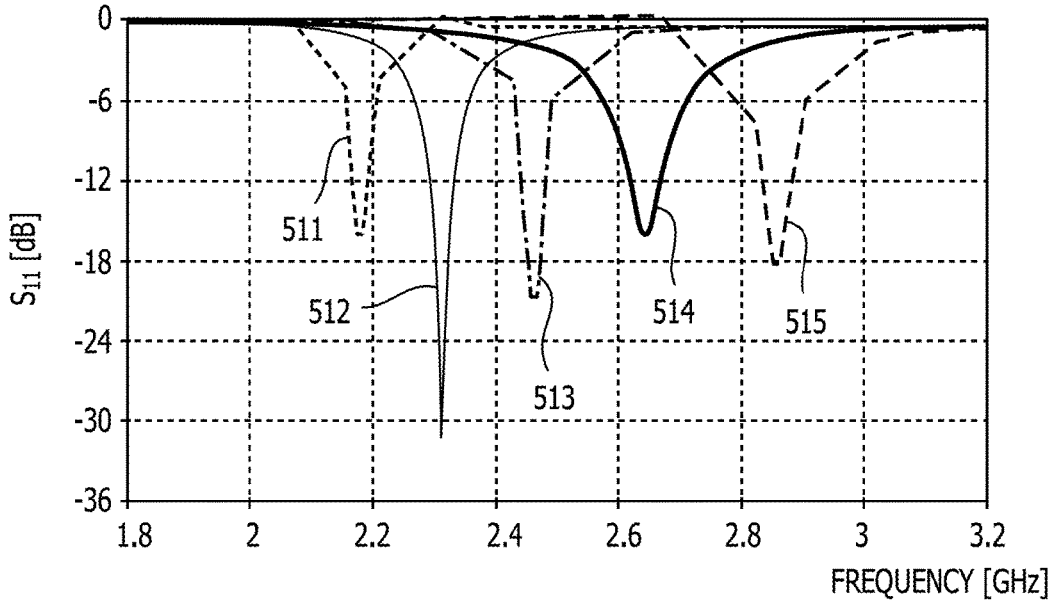
FIG. 5B illustrates an example of the frequency response of the $S_{11}$ parameter of the loop antenna when the distance between both ends of the emitting element is changed.

FIG. 5A illustrates an example of the frequency response of the $S_{11}$ parameter of the loop antenna 1 when the length sy of each slit 4*a* obtained by the electromagnetic field simulation is changed. FIG. 5B illustrates an example of the frequency response of the $S_{11}$ parameter of the loop antenna 1 when the distance d between both ends of the emitting element 4 obtained by the electromagnetic field simulation is changed. In FIG. 5A and FIG. 5B, the horizontal axes indicate frequencies, and the vertical axis indicates the $S_{11}$ parameter.

In FIG. 5A, graph 501 illustrates the frequency response of the $S_{11}$ parameter of the loop antenna 1 when sy=6 mm. Graph 502 illustrates the frequency response of the $S_{11}$ parameter of the loop antenna 1 when sy=9 mm. Graph 503 illustrates the frequency response of the $S_{11}$ parameter of the loop antenna 1 when sy=12 mm. Further, graph 504 illustrates the frequency response of the $S_{11}$ parameter of the loop antenna 1 when sy=15 mm.

As illustrated in graphs 501 to 504, the minimum value of the $S_{11}$ parameter changes by changing the length sy of each slit 4*a*. This suggests that the capacitive component of the loop antenna 1 changes by changing the length sy of each slit 4*a*, and as a result, the impedance of the loop antenna 1 changes. In this example, the $S_{11}$ parameter at 2.45 GHz is minimized when sy=9 mm, and the impedance of the loop antenna 1 is most matched to a predetermined impedance (for example, 50Ω). Further, even if the length sy of each slit 4*a* is changed, the frequency at which the $S_{11}$ parameter is at the minimum is hardly changed.

In FIG. 5B, graph 511 illustrates the frequency response of the $S_{11}$ parameter of the loop antenna 1 when d=6 mm. Graph 512 illustrates the frequency response of the $S_{11}$ parameter of the loop antenna 1 when d=8 mm. Graph 513 illustrates the frequency response of the $S_{11}$ parameter of the loop antenna 1 when d=10 mm. Graph 514 illustrates the frequency response of the $S_{11}$ parameter of the loop antenna 1 when d=12 mm. Graph 515 illustrates the frequency response of the $S_{11}$ parameter of the loop antenna 1 when d=14 mm.

As illustrated in graphs 511 to 515, the frequency at which the $S_{11}$ parameter is at the minimum is changed by changing the distance d between both ends of the emitting element 4. This is because the length of the emitting element 4 along the loop decreases as the distance d between both ends of the emitting element 4 increases, and as a result, the frequency at which the emitting element 4 resonates increases.

Thus, the impedance and the resonance frequency of the loop antenna 1 may be adjusted by adjusting the length sy of each slit 4*a* formed in the emitting element 4 of the loop antenna 1 or the distance d between both ends of the emitting element 4.

The loop antenna is configured so that an emitting element that forms a loop is electromagnetically coupled to a feeding element formed in a dipole shape at the both ends and is fed with power from the feeding element via electromagnetic coupling. Therefore, the antenna characteristics of this loop antenna may be adjusted so that the degradation of the antenna characteristics due to a difference in installation environment is suppressed by adjusting the width or length of the gap between the feeding element and the emitting element at the positions where electromagnetic coupling occurs. The impedance of this loop antenna can be adjusted by adjusting the width or length of the gap between the feeding element and the emitting element. This allows the impedance of the loop antenna, even if it is formed as a compact antenna, to be matched to the impedance of a circuit coupled to the loop antenna without using a matching circuit.

For example, the distance L between one end of the emitting element 4 electromagnetically coupled to one end of the feeding element 3 and the other end of the emitting element 4 electromagnetically coupled to the other end of the feeding element 3 may be $n\lambda<L<(n+0.5)\lambda$, where $\lambda$ is an electrical length corresponding to the design wavelength, and n is an integer greater than or equal to 1. Also in this case, the direction of an electric current at the position where the feeding element 3 and the emitting element 4 are electromagnetically coupled at one end side of the feeding element 3 and the direction of an electric current at the position where the feeding element 3 and the emitting element 4 are electromagnetically coupled at the other end side of the feeding element 3 are substantially the same. This allows the radio waves emitted from each of both ends of the emitting element 4 to intensify each other, increasing the operation gain.

For example, a lumped parameter element for adjusting the antenna characteristics may be provided between the feeding element and the emitting element.

Figure 6:
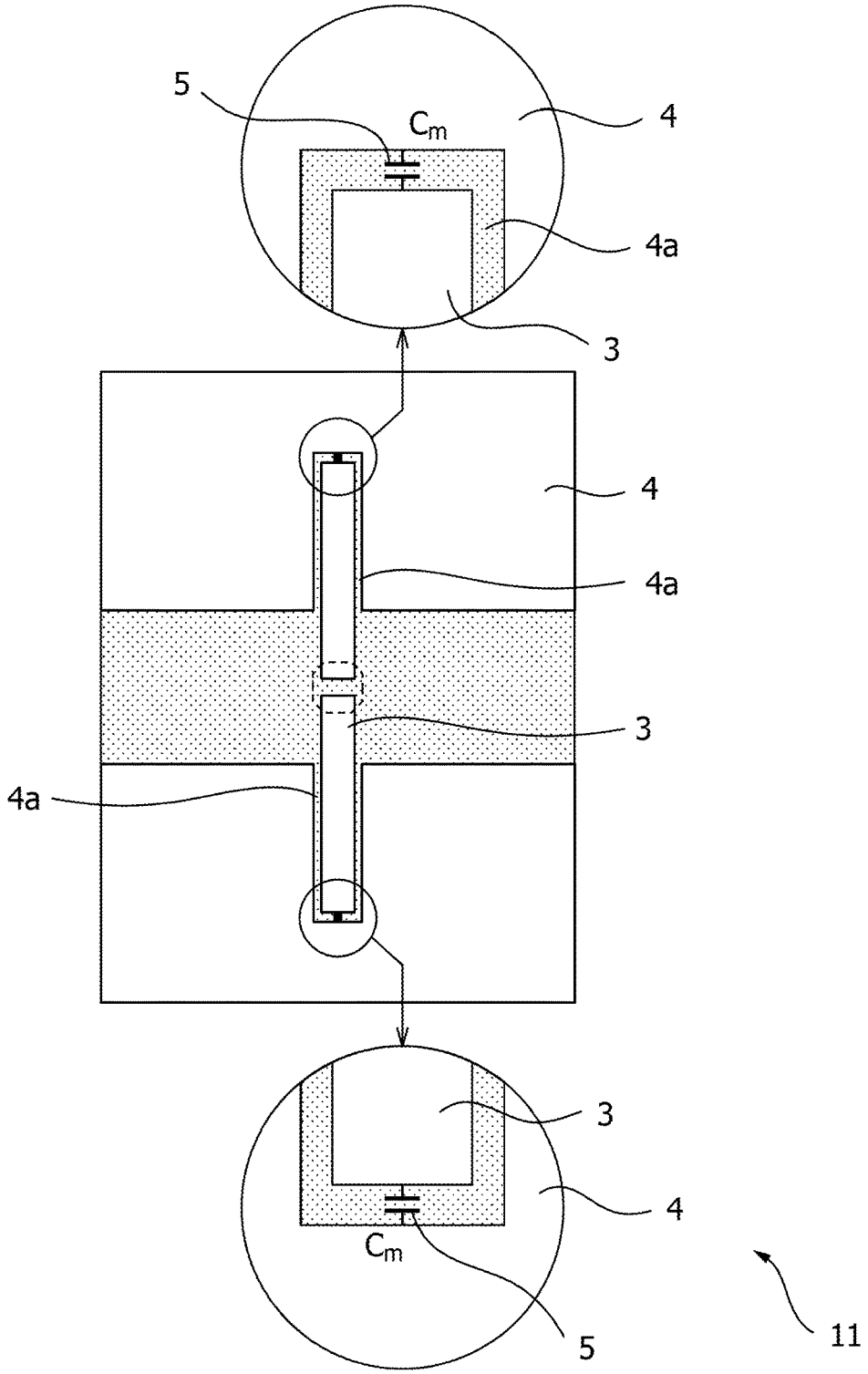
FIG. 6 illustrates an example of a plan view of a loop antenna.

FIG. 6 illustrates an example of a plan view of a loop antenna. The loop antenna 11 differs from the loop antenna 1 in that a capacitive element 5 coupling the feeding element 3 and the emitting element 4 is provided in each slit 4*a* of the emitting element 4 at each end of the feeding element 3.

The capacitive element 5 is an example of the lumped parameter element and is a capacitor having electrostatic capacitance $C_m$. Therefore, the impedance and the resonance frequency of the loop antenna 11 change according to the electrostatic capacitance $C_m$ of the capacitive element 5.

Figure 7:
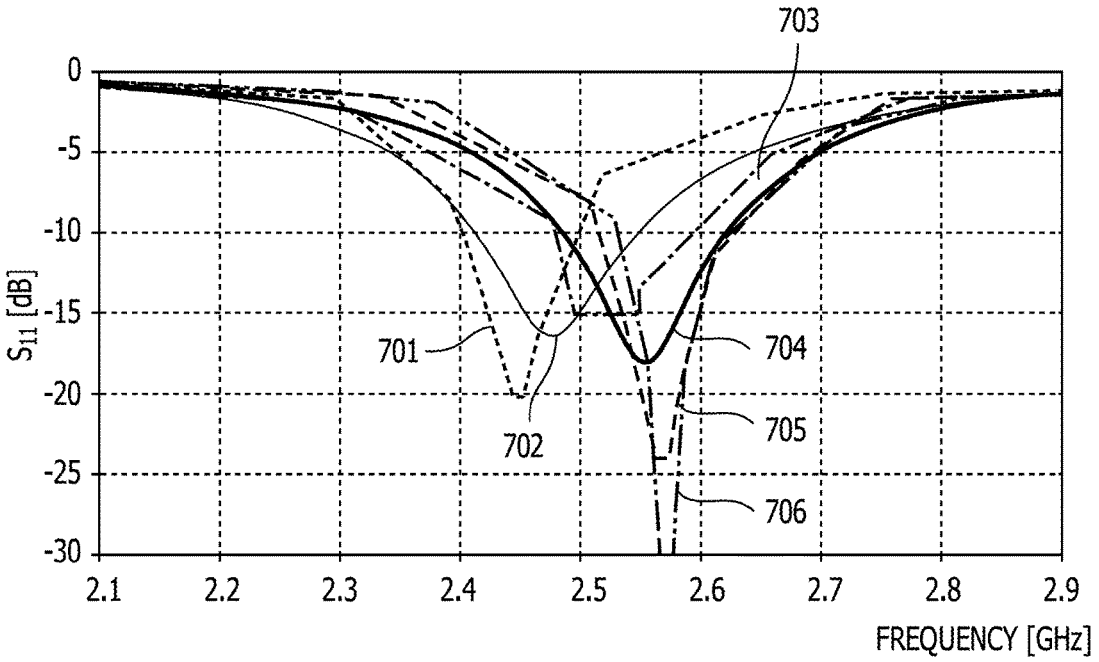
FIG. 7 illustrates an example of the frequency response of the $S_{11}$ parameter of the loop antenna when the electrostatic capacitance of the capacitive element is changed.

FIG. 7 illustrates an example of the frequency response of the $S_{11}$ parameter of the loop antenna 11 when the electrostatic capacitance $C_m$ of the capacitive element 5 obtained by electromagnetic field simulation is changed. In FIG. 7, the horizontal axis indicates frequencies, and the vertical axis indicates the $S_{11}$ parameter. In this electromagnetic field simulation, the loop antenna 11 is disposed on a metal plate so that the back side is in contact with the metal plate. In the electromagnetic field simulation, the conductivity of the feeding element 3 and the emitting element 4 was set to $5.96\times10^7$ [S/m]. The length of the substrate 2 along the longitudinal direction of the feeding element 3 was set to 38 mm. The length of the feeding element 3 in the longitudinal direction was set to 29 mm, and the distance between both ends of the emitting element 4 was set to 9 mm. The dimensions of the parts other than the above and the electrical property of the substrate 2 may the same as the dimensions and the electrical property illustrated in FIG. 2A and FIG. 2B.

In FIG. 7, graph 701 illustrates the frequency response of the $S_{11}$ parameter of the loop antenna 11 when $C_m$=0 pF. Graph 702 illustrates the frequency response of the $S_{11}$ parameter of the loop antenna 11 when $C_m$=0.4 pF. Graph 703 illustrates the frequency response of the $S_{11}$ parameter of the loop antenna 11 when $C_m$=0.8 pF. Graph 704 illustrates the frequency response of the $S_{11}$ parameter of the loop antenna 11 when $C_m$=1.2 pF. Graph 705 illustrates the frequency response of the $S_{11}$ parameter of the loop antenna 11 when $C_m$=1.6 pF. Graph 706 illustrates the frequency response of the $S_{11}$ parameter of the loop antenna 11 when $C_m$=2 pF.

As illustrated in graphs 701 to 706, the resonance frequency is adjusted so that a frequency band in which the $S_{11}$ parameter is −6 dB or less is included in the range from 2.35 GHz to 2.65 GHz by adjusting the electrostatic capacitance $C_m$ of the capacitive element 5. Since the minimum value of the $S_{11}$ parameter is changed by adjusting the electrostatic capacitance $C_m$ of the capacitive element 5, the impedance of the loop antenna 11 is also changed.

The position where the capacitive element 5 is disposed is not limited to both ends of the feeding element 3 but may be disposed so that the feeding element 3 and the emitting element 4 are coupled at any position in each slit 4*a*. The capacitive element 5 is preferably disposed in each of the two slits 4*a* so that the emission pattern of the loop antenna 11 is symmetrical about the front direction in the longitudinal direction of the feeding element 3.

The lumped parameter element that couples the feeding element 3 and the emitting element 4 is not limited to the capacitive element 5. For example, the lumped parameter element may be an inductance element having an inductance component.

For example, the shape of the feeding element 3 may not be linear.

Figure 8A:
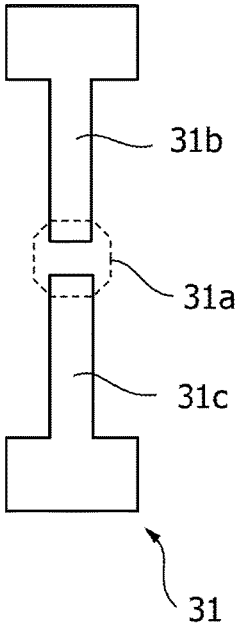
FIGS. 8A to 8C illustrate examples of the shape of a feeding element.
Figure 8B:
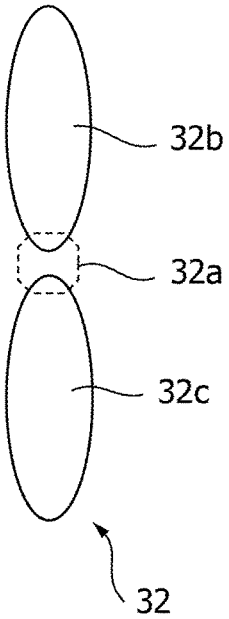
Figure 8C:
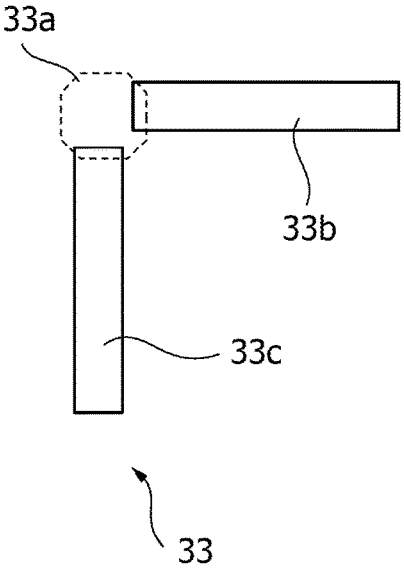

FIGS. 8A to 8C illustrate examples of the shape of a feeding element. In a feeding element 31 illustrated in FIG. 8A, each of a first portion 31*b* extending from a feeding point 31*a* in a first direction and a second portion 31*c* extending from the feeding point 31*a* in a second direction is formed in T-shape. For example, the feeding element 31 is formed so that each of the width of an end of the first portion 31*b* and the width of an end of the second portion 31*c* is larger than the width of the feeding element 31 at the feeding point 31*a*.

In a feeding element 32 illustrated in FIG. 8B, both of a first portion 32*b* extending from a feeding point 32*a* in a first direction and a second portion 32*c* extending from the feeding point 32*a* in a second direction are relatively large in width between the feeding point 32*a* and an end. In FIG. 8C, a feeding element 33 is bent at right angles at a feeding point 33*a* so that a direction in which a first portion 33*b* extends from a feeding point 33*a* to one end and a direction in which a second portion 33*c* extends from the feeding point 33*a* to the other end intersect at right angles. Thus, the feeding element 33 has a substantially L-shape.

In any of the feeding elements 31 to 33, the length of the first portion and the length of the second portion are preferably equal to each other so that the emission direction of radio wave is not biased. Any of the feeding elements 31 to 33 are preferably disposed so that each of the ends of the feeding elements is positioned in the slit formed at each of both ends of the emitting element, and that the feeding element and the emitting element are electromagnetically coupled, as in the above embodiment.

Figure 9:
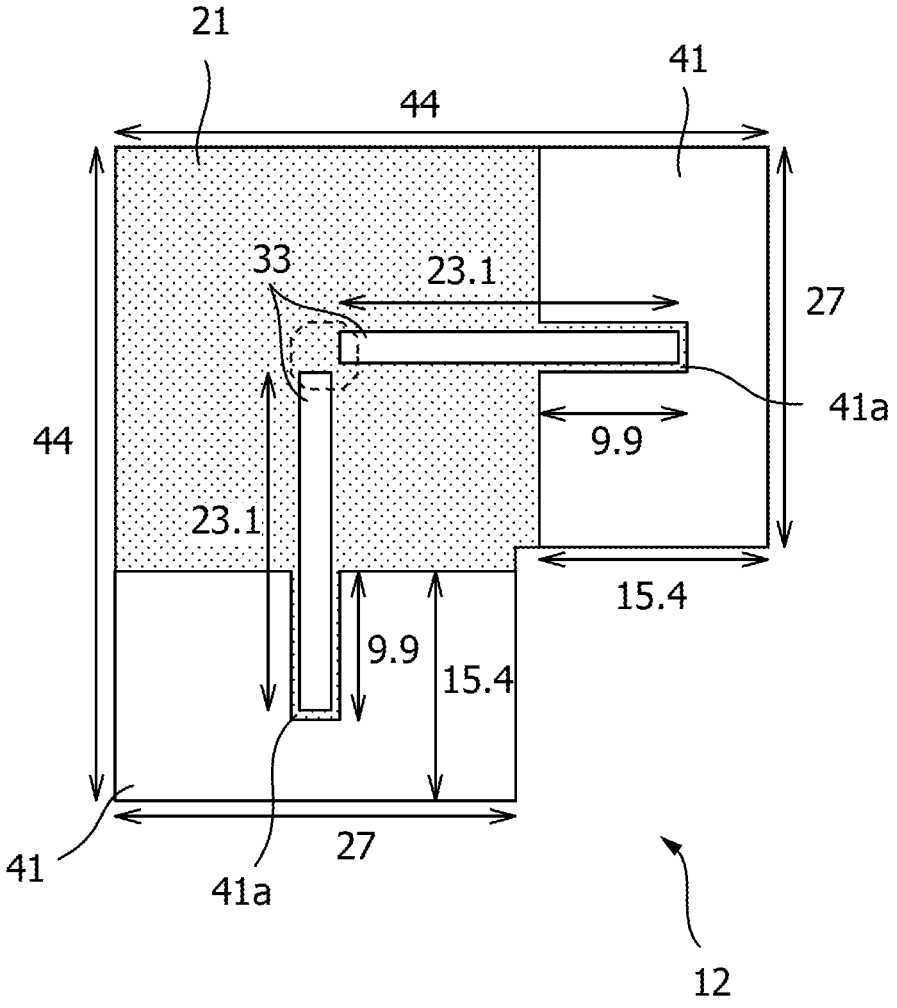
FIG. 9 illustrates an example of a plan view of a loop antenna including the feeding element illustrated in FIG. 8C.

FIG. 9 illustrates an example of a plan view of a loop antenna 12 including the feeding element 33 illustrated in FIG. 8C. The loop antenna 12 differs in the shapes of a substrate 21, the feeding element 33, and an emitting element 41 as compared with the loop antenna 1. In this example, the substrate 21 is formed in L-shape. The feeding element 33 is disposed on the front surface of the substrate 21 so as to be substantially similar in shape to the substrate 21. Both ends of the emitting element 41 are positioned on the front surface of the substrate 21, and the emitting element 41 is bent at end of the substrate 21 close to the end of each of the feeding element 33 to form a loop on a surface perpendicular to the front surface of the substrate 21. At both ends of the emitting element 41, slits 41*a* are formed along the feeding element 33. One end of the feeding element 33 is disposed in each of the two slits 41*a*. With this, the emitting element 41 is fed with power from the feeding element 33 at each of both ends thereof via electromagnetic coupling with the feeding element 33.

Figure 10A:
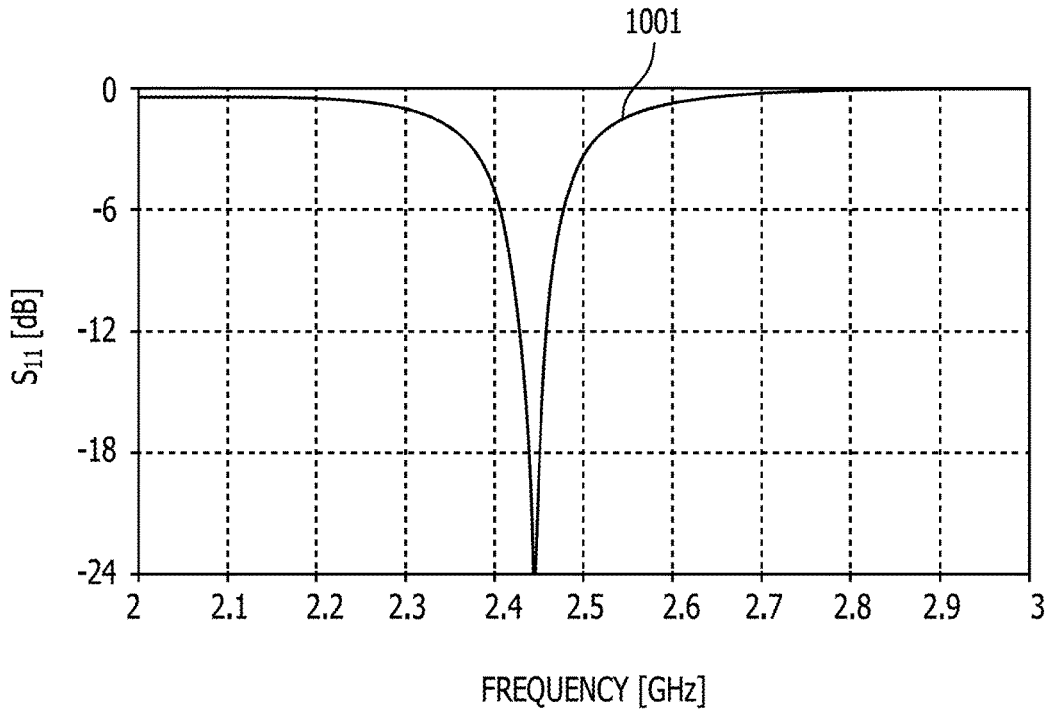
FIG. 10A illustrates the frequency response of the $S_{11}$ parameter of the loop antenna illustrated in FIG. 9.
Figure 10B:
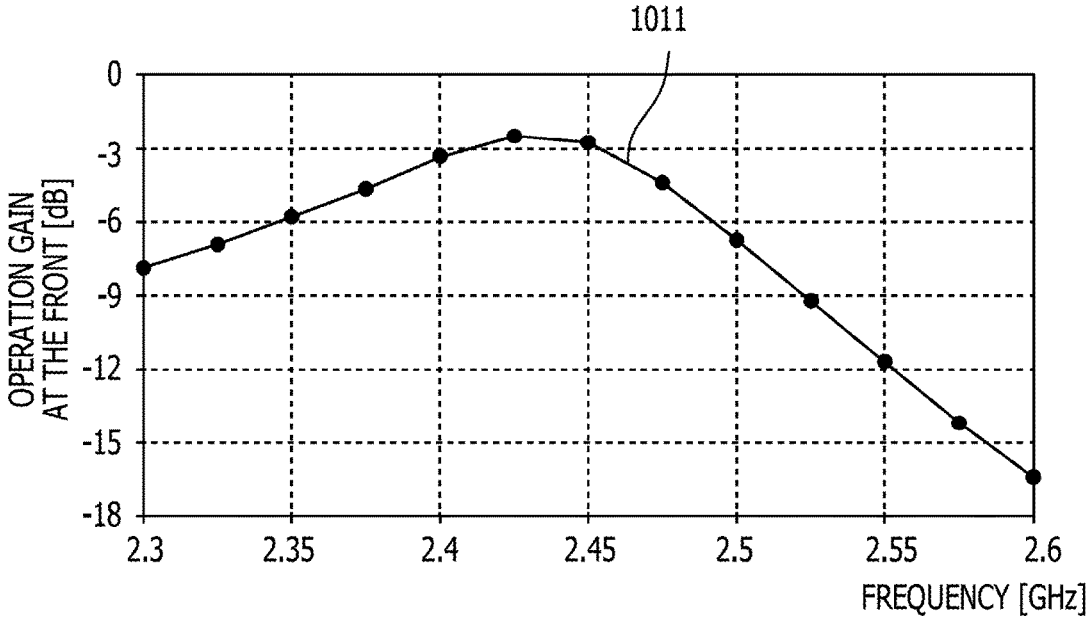
FIG. 10B illustrates an example of the frequency response of the operation gain of the loop antenna illustrated in FIG. 9.

FIG. 10A illustrates an example of the frequency response of the $S_{11}$ parameter of the loop antenna 12 obtained by an electromagnetic field simulation. FIG. 10B illustrates an example of the frequency response of the operation gain of the loop antenna 12 at the front direction obtained by the electromagnetic field simulation. In FIGS. 10A and 10B, the horizontal axes indicate frequencies. In FIG. 10A, the vertical axis indicates the $S_{11}$ parameter, and in FIG. 10B, the vertical axis indicates the operation gain.

In this simulation, the relative dielectric constant εr of the substrate 21 was set to 4.0, and the dielectric dissipation factor tangent tan δ of the substrate 21 was set to 0.02. The conductivity of the feeding element 33 and the emitting element 41 was set to $5.96\times10^7$ [S/m].

The lengths of the substrate 21 in directions perpendicular to each other were set to 44 mm, and the thickness of the substrate 21 was set to 1 mm. The lengths of the feeding element 33 from the feeding point 33*a* to ends on the both sides were set to 23.1 mm, and the width of the feeding element 33 was set to 2.2 mm. The width of the emitting element 41 along the width of the feeding element 33 was set to 27 mm, and the length of the emitting element 41 from the end of the substrate 21 at which the emitting element 41 is bent to the end of the emitting element 41 was set to 15.4 mm. The length of each of the two slits 41*a* was set to 9.9 mm, and the width of each slit 41*a* was set to 3 mm. For example, the gap between the feeding element 33 and the emitting element 41 in the slit 41*a* was set to 0.4 mm.

In FIG. 10A, graph 1001 illustrates the frequency response of the $S_{11}$ parameter of the loop antenna 12 in the case where the loop antenna 12 is disposed on the back side of the substrate 21 so as to be in contact with a metal plate. As illustrated in graph 1001, the $S_{11}$ parameter is −6 dB or less at an operating frequency of 2.45 GHz in the case where the loop antenna 12 is disposed on metal.

In FIG. 10B, graph 1011 illustrates the frequency response of an operation gain at the front direction of the loop antenna 12 in the case where the loop antenna 12 is disposed in contact with a metal plate on the back side of the substrate 21. As illustrated in graph 1011, the operation gain is about −3 dB at an operating frequency of 2.45 GHz, so that a sufficient operation gain can be given even when the loop antenna 12 is disposed on metal.

For example, a lumped parameter element that couples the feeding element and the emitting element may be disposed in each of the slits at both ends of the emitting element.

For example, the emitting element may have no slit.

Figure 11:
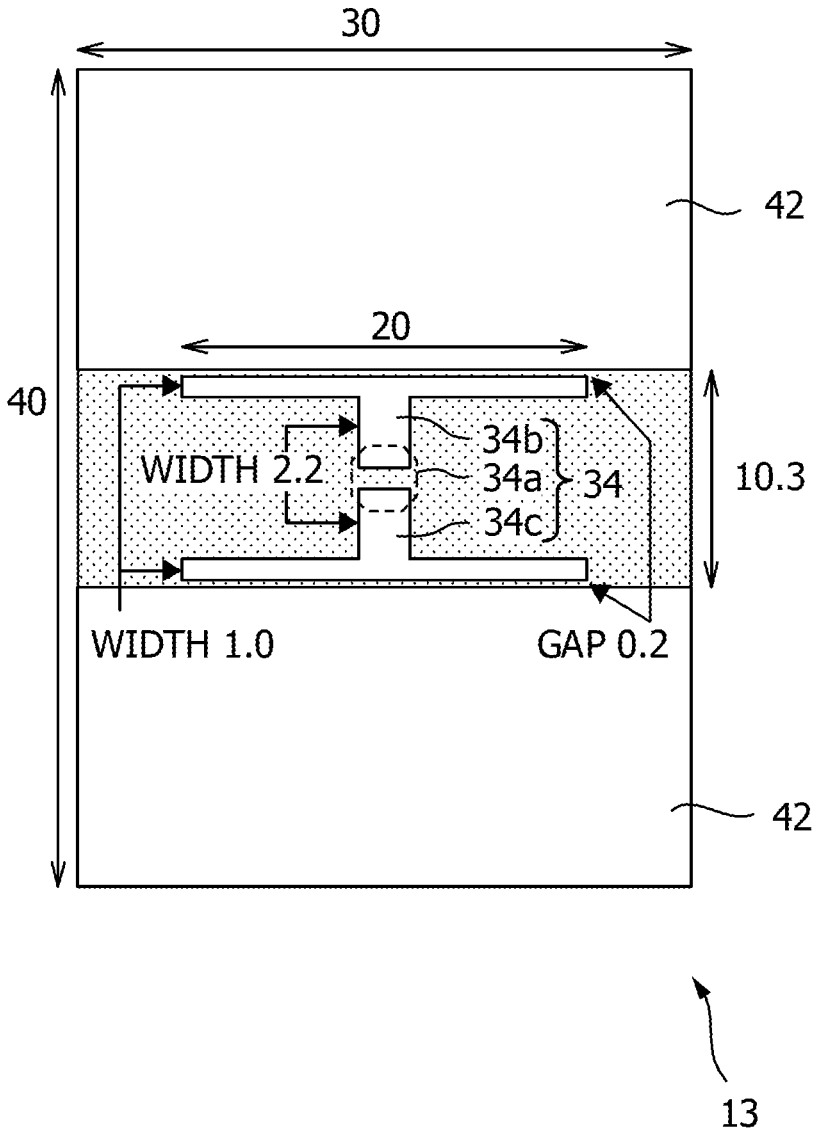
FIG. 11 illustrates an example of a plan view of a loop antenna.

FIG. 11 illustrates an example of a plan view of a loop antenna. As compared with the loop antenna 1, the loop antenna 13 differs from the loop antenna 1 in the shape of both ends of the feeding element and that the emitting element has no slit.

An emitting element 42 has no slit at both ends thereof. Instead, both ends of the feeding element 34 expand along the ends of the emitting element 42. For example, both a first portion 34*b* of the feeding element 34 extending from a feeding point 34*a* in a first direction and a second portion 34*c* extending from the feeding point 34*a* in a second direction opposite to the first direction are formed in T-shape. The feeding element 34 and the emitting element 42 are disposed so that one end of the feeding element 34 and one end of the emitting element 42 face each other, with a gap through which electromagnetic coupling is allowed therebetween, and the other end of the feeding element 34 and the other end of the emitting element 42 face each other, with a gap through which electromagnetic coupling is allowed therebetween. The length of the first portion 34*b* along the first direction and the length of the second portion 34*c* along the second direction are preferably equal to each other.

Figure 12A:
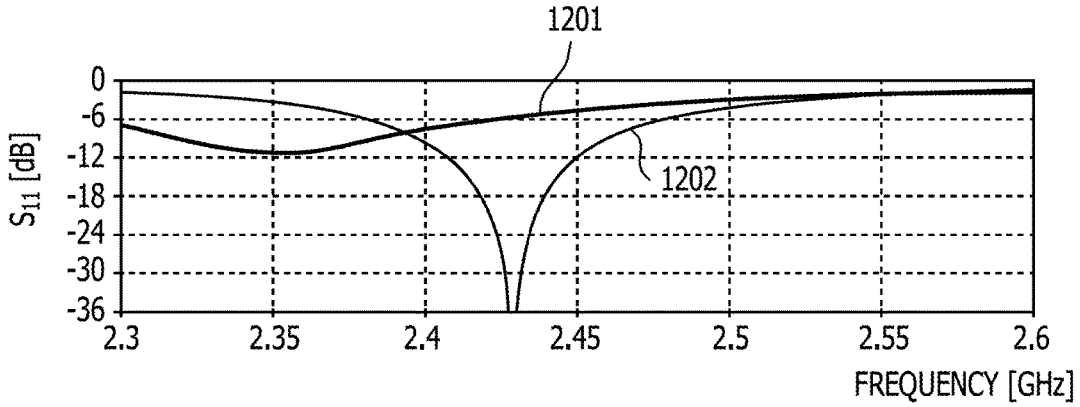
FIG. 12A illustrates an example of the frequency response of the $S_{11}$ parameter of the loop antenna illustrated in FIG. 11.
Figure 12B:
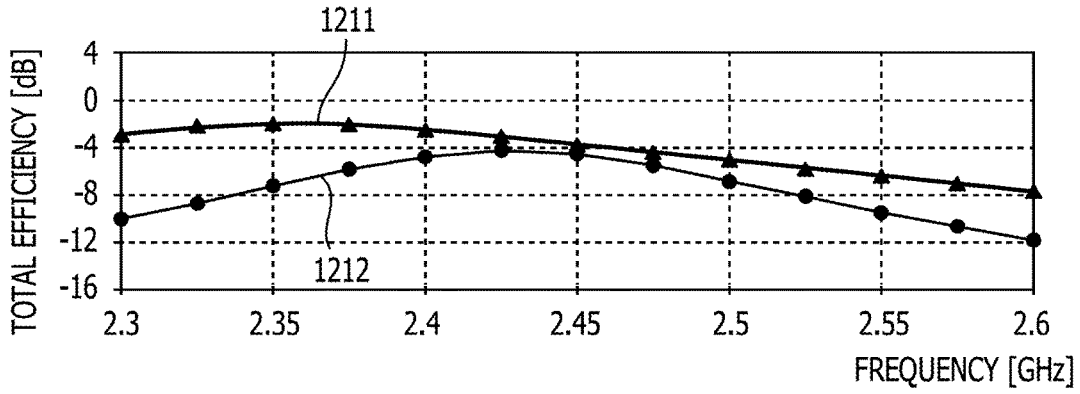
FIG. 12B illustrates an example of the frequency response of the total efficiency of the loop antenna illustrated in FIG. 11.
Figure 12C:
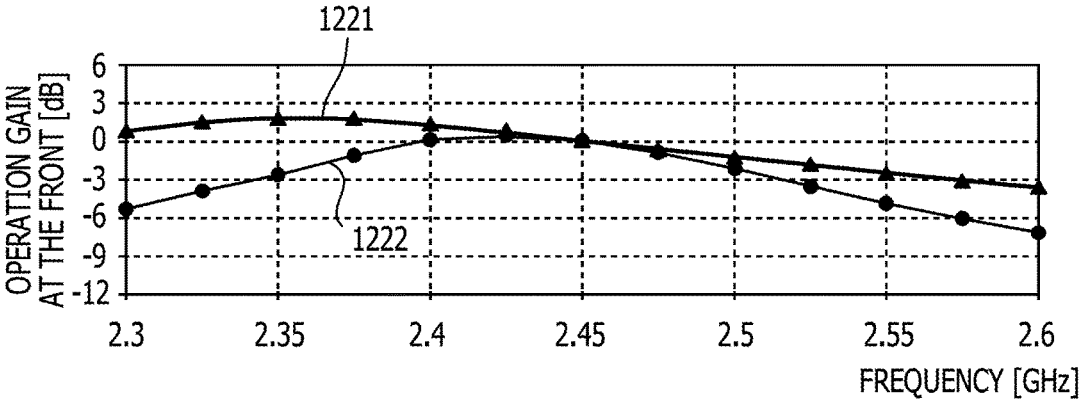
FIG. 12C illustrates an example of the frequency response of the operation gain of the loop antenna illustrated in FIG. 11.

FIG. 12A illustrates an example of the frequency response of the $S_{11}$ parameter of the loop antenna 13 obtained by an electromagnetic field simulation. FIG. 12B illustrates an example of the frequency response of the total efficiency of the loop antenna 13 obtained by the electromagnetic field simulation. FIG. 12C illustrates and example of the frequency response of the operation gain of the loop antenna 13 at the front direction, obtained by the electromagnetic field simulation. In FIGS. 12A to 12C, the horizontal axes indicate frequencies. In FIG. 12A, the vertical axis indicates $S_{11}$ parameter. In FIG. 12B, the vertical axis indicates total efficiency. In FIG. 12C, the vertical axis indicates operation gain.

In this simulation, the operating frequency of the loop antenna 13 was 2.45 GHz. The relative dielectric constant εr of the substrate 2 was set to 4.0, and the dielectric dissipation factor tangent tan δ of the substrate 2 was set to 0.02. Further, the conductivity of the feeding element 34 and the emitting element 42 was set to $5\times10^7$ [S/m].

The length of the substrate 2 along a direction in which a loop is formed of the emitting element 42 was set to 40 mm, and the thickness of the substrate 2 was set to 1 mm. The width of the emitting element 42 in a direction perpendicular to the direction in which the loop is formed was set to 30 mm, and the distance between both ends of the emitting element 42 was set to 10.3 mm. The lengths of both ends of the feeding element 34 in a direction parallel to the ends of the emitting element 42 were set to 20 mm, and the width along the direction in which the loop is formed was set to 1 mm. Further, the gap between an end of the feeding element 34 and an end of the emitting element 42 was set to 0.2 mm. The width of a portion of the feeding element 34 coupling both ends thereof was set to 2.2 mm.

FIG. 12A, graph 1201 illustrates the frequency response of the $S_{11}$ parameter of the loop antenna 13 in the case where the loop antenna 13 is disposed in the air. Graph 1202 illustrates the frequency response of the $S_{11}$ parameter of the loop antenna 13 in the case where the loop antenna 13 is disposed in contact with a metal plate on the back side of the substrate 2. As illustrated in graph 1201 and graph 1202, the $S_{11}$ parameter is less than −3 dB at an operating frequency of 2.45 GHz in any of the case where the loop antenna 13 is disposed in the air and the case where the loop antenna 13 is disposed on metal.

In FIG. 12B, the graph 1211 illustrates the frequency response of the total efficiency of the loop antenna 13 in the case where the loop antenna 13 is disposed in the air. Graph 1212 illustrates the frequency response of the total efficiency of the loop antenna 13 in the case where the loop antenna 13 is disposed in contact with a metal plate on the back side of the substrate 2. As illustrated in graph 1211 and graph 1212, the total efficiency in the case where the loop antenna 13 is disposed in the air and in the case where the loop antenna 13 is disposed on metal are substantially equal at an operating frequency of 2.45 GHz.

In FIG. 12C, graph 1221 illustrates the frequency response of the operation gain at the front of the loop antenna 13 in the case where the loop antenna 13 is disposed in the air. Graph 1222 illustrates the frequency response of the operation gain at the front of the loop antenna 13 in the case where the loop antenna 13 is disposed in contact with a metal plate on the back side of the substrate 2. As illustrated in graph 1221 and graph 1222, the operation gain at the front when the loop antenna 13 is disposed in the air and the operation gain at the front when the loop antenna 13 is disposed on metal are substantially equal at an operating frequency of 2.45 GHz.

As described above, even when the emitting element has no slit at both ends, the emitting element is fed with power at both ends from the feeding element via electromagnetic coupling, so that degradation in antenna performance of the loop antenna due to a difference in installation environment may be reduced. For example, a lumped parameter element that couples the feeding element and the emitting element may be provided in each of the gap between one end of the feeding element and one end of the emitting element and the gap between the other end of the feeding element and the other end of the emitting element.

For example, the emitting element may includes a plurality of conductors. For example, the radiating conductor may be formed of two plate-like conductors, like the loop antenna disclosed in Japanese Laid-open Patent Publication No. 2011-109552. In this case, as in the above embodiment and modifications, one end of each conductor is positioned on the front surface of the substrate and face each other so as to be electromagnetically coupled to the feeding element. Each conductor is bent at the ends of the substrate in the longitudinal direction of the feeding element, and the other ends of the conductors are disposed so as to overlap with each other at the back side of the substrate. A dielectric sheet may be disposed between two conductors at a portion on the back side of the substrate where the two conductors overlap. The two conductors are electromagnetically coupled via the dielectric sheet. For example, the antenna characteristics of the loop antenna may be adjusted by adjusting the gap between the two conductors on the back side of the substrate.

Figure 13:
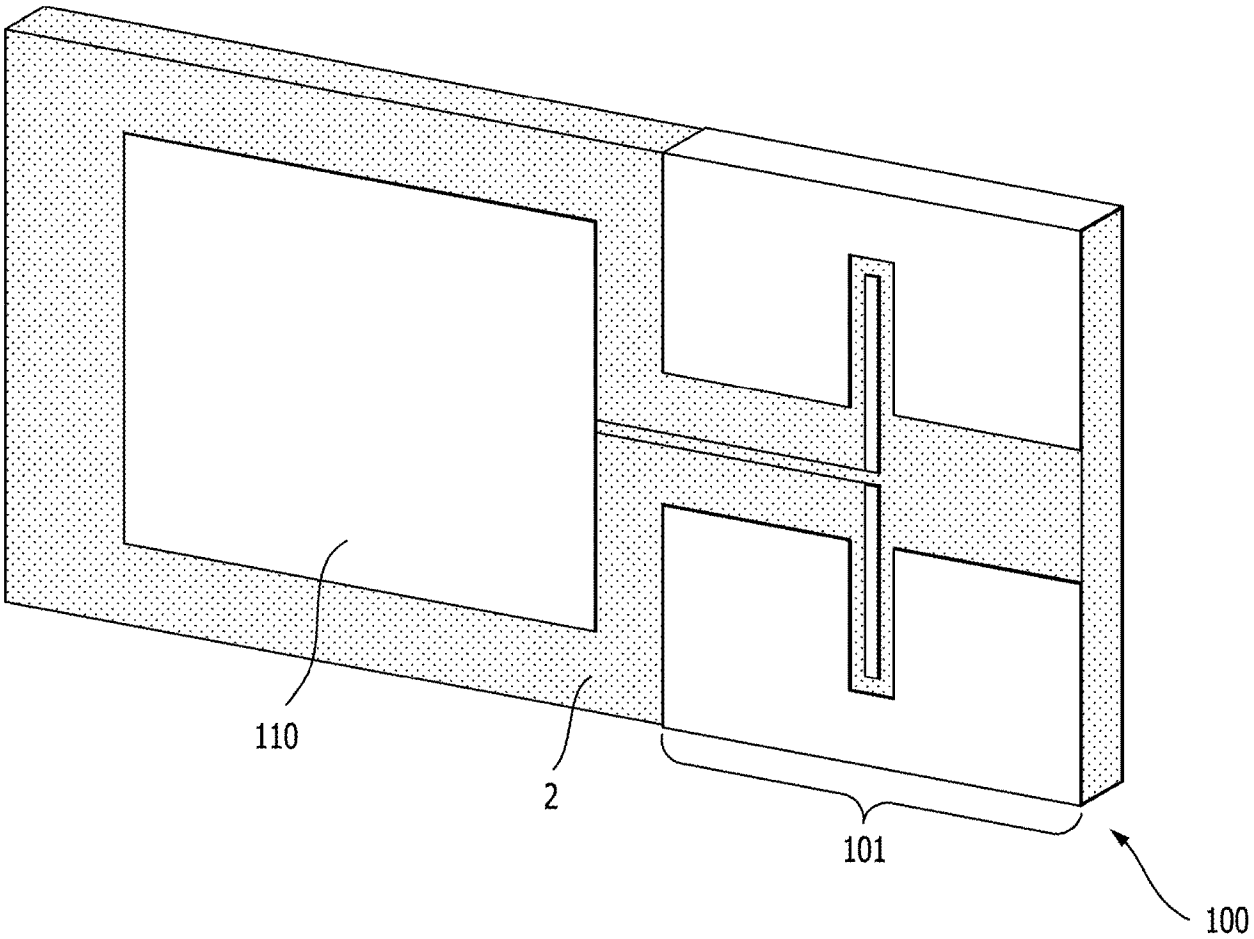
FIG. 13 illustrates an example of a perspective view of an electronic apparatus including a loop antenna viewed from the front surface of a substrate.
Figure 14:
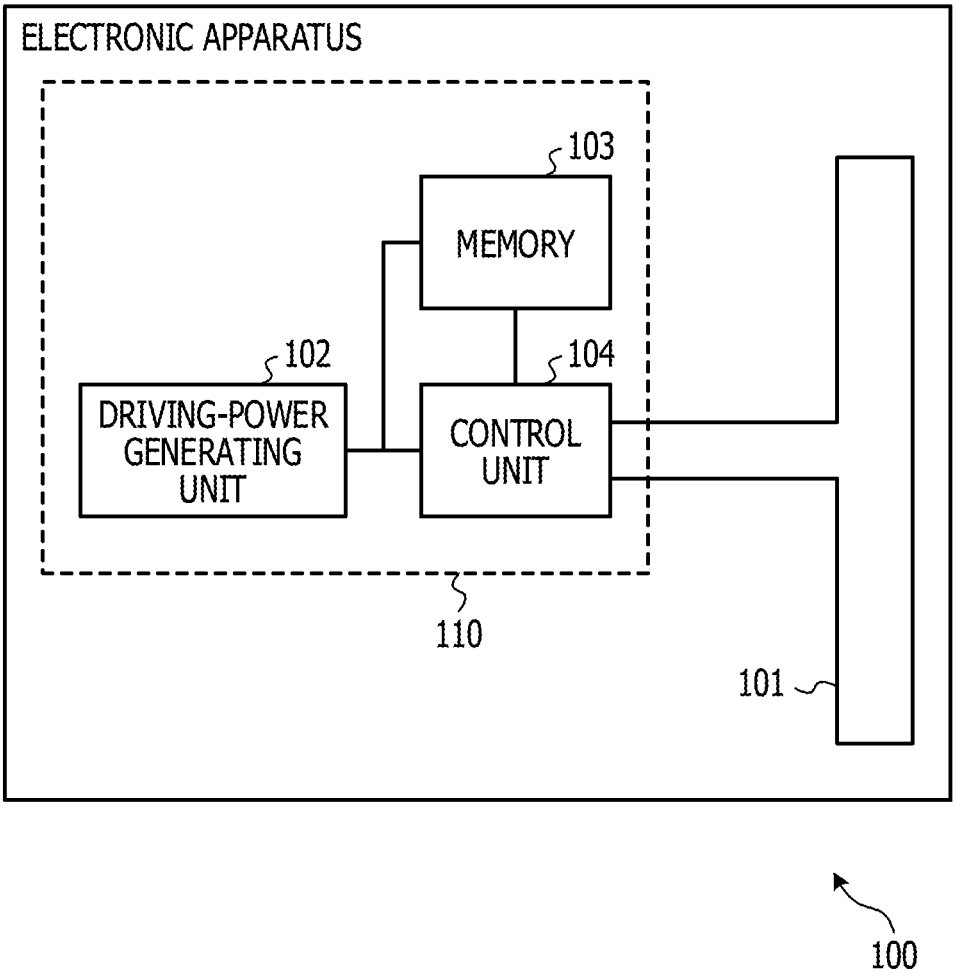
FIG. 14 illustrates a circuit of the electronic apparatus illustrated in FIG. 13.

FIG. 13 illustrates an example of a perspective view of an electronic apparatus including a loop antenna viewed from the front surface side of the substrate 2. FIG. 14 is a block diagram of a circuit of the electronic apparatus. In FIG. 13, the electronic apparatus 100 may be a beacon apparatus and includes a loop antenna 101, a driving-power generating unit 102, a memory 103, and a control unit 104. The driving-power generating unit 102, the memory 103, and the control unit 104 may be an example of a signal processing circuit 110 that emits a radio signal via the loop antenna 101. The memory 103 and the control unit 104 are formed as, for example, one or a plurality of integrated circuits. The signal processing circuit 110 is disposed in an area on the front surface of the substrate 2 of the loop antenna 101 where the feeding element and the emitting element of the loop antenna 101 are not disposed.

The loop antenna 101 is a loop antenna. Further, for example, the loop antenna 101 emits radio signals received from the control unit 104 as radio waves.

The driving-power generating unit 102 generates electric power for driving the memory 103 and the control unit 104. For that purpose, the driving-power generating unit 102 includes, for example, a solar battery. The driving-power generating unit 102 further includes a storage device, such as a condenser, for storing electric power generated by the solar battery. Further, the driving-power generating unit 102 supplies the generated electric power to the memory 103 and the control unit 104.

The memory 103 includes a non-volatile semiconductor memory circuit. Further, the memory 103 stores ID code for distinguishing the electronic apparatus 100 from other electronic apparatuses.

The control unit 104 includes at least one processor and generates a radio signal conforming to a predetermined wireless communication standard, such as Bluetooth Low Energy (BLE). In this case, the control unit 104 may read the ID code of the electronic apparatus 100 from the memory 103 and include the ID code in the radio signal. The control unit 104 outputs the radio signal to the loop antenna 101 and causes the loop antenna 101 to emit the radio signal as radio waves.

The electronic apparatus 100 may be a sensor terminal for use in the Internet of Things (IoT). In this case, the electronic apparatus 100 may include one or more sensors for detecting information on an object to which the electronic apparatus 100 is to be mounted, in addition to each of the above components. The control unit 104 may include information obtained from the sensor in the radio signal.

Alternatively, the electronic apparatus 100 may also be a wireless tag. In this case, the driving-power generating unit 102 may generate electric power for driving the memory 103 and the control unit 104 from a radio signal received from a reader writer via the loop antenna 101. The control unit 104 demodulates the radio signal received from the loop antenna 101 to extract an query signal carried by the radio signal. The control unit 104 may generate a response signal responsive to the query signal. At that time, the control unit 104 reads ID code from the memory 103 and includes the ID code in the response signal. The control unit 104 superposes the response signal on a radio signal having a frequency for emission from the loop antenna 101. The control unit 104 outputs the radio signal to the loop antenna 101 and causes the loop antenna 101 to emit the radio signal as radio waves.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A loop antenna comprising:

a substrate;

a feeding element including a first portion and a second portion which are provided on a first surface of the substrate, have electrical conductivity, are fed with electric power from a feeding point, the first portion extending from the feeding point in a first direction, the second portion extending from the feeding point in a second direction; and an emitting element which has electrical conductivity, is formed in a loop shape in such a manner that the emitting element surrounds the substrate along a surface perpendicular to the first surface, and includes a first end provided so as to electromagnetically couple to the first portion of the feeding element on the first surface and a second end provided so as to electromagnetically couple to the second portion of the feeding element on the first surface, a gap being disposed between the first end and the second end, wherein the emitting element includes a first slit at the first end and a second slit at the second end, the first portion of the feeding element is disposed in the first slit with a first gap that allows electromagnetic coupling, and the second portion of the feeding element is disposed in the second slit with a second gap that allows electromagnetic coupling.

2. The loop antenna according to claim 1, further comprising:

a first lumped parameter element, including a first capacitive component or a first inductance component, which connects the first end of the emitting element and the first portion of the feeding element together; and a second lumped parameter element, including a second capacitive component or a second inductance component, which couples the second end of the emitting element and the second portion of the feeding element together.

3. The loop antenna according to claim 1, wherein a first gap through which the first portion and the emitting element electromagnetically couple is provided between an end of the first portion of the feeding element and the first end of the emitting element, and wherein a second gap through which the second portion and the emitting element electromagnetically couple is provided between an end of the second portion of the feeding element and the second end of the emitting element.

4. The loop antenna according to claim 1, wherein a length of an end of the first portion along the first end and a length of an end of the second portion along the second end are larger than a width of the feeding element at the feeding point.

5. The loop antenna according to claim 1, wherein a total of a length of the first portion of the feeding element along the first direction and a length of the second portion of the feeding element along the second direction is one half or less of an electrical length of a design wavelength.

6. An electronic apparatus comprising:

a loop antenna; and a signal processing circuit that emits or receives radio waves via the loop antenna, wherein the loop antenna includes:

a substrate;

a feeding element including a first portion and a second portion which are provided on a first surface of the substrate, have electrical conductivity, are fed with electric power from a feeding point, the first portion extending from the feeding point in a first direction, the second portion extending from the feeding point in a second direction; and an emitting element which has electrical conductivity, is formed in a loop shape in such a manner that the emitting element surrounds the substrate along a surface perpendicular to the first surface, and includes a first end provided so as to electromagnetically couple to the first portion of the feeding element on the first surface and a second end provided so as to electromagnetically couple to the second portion of the feeding element on the first surface, a gap being disposed between the first end and the second end, the signal processing circuit is disposed in an area on the first surface of the substrate in which the feeding element and the emitting element are not disposed, wherein the emitting element includes a first slit at the first end and a second slit at the second end, the first portion of the feeding element is disposed in the first slit with a first gap that allows electromagnetic coupling, and the second portion of the feeding element is disposed in the second slit with a second gap that allows electromagnetic coupling.

7. The electronic apparatus according to claim 6, wherein the loop antenna includes: a first lumped parameter element, including a first capacitive component or a first inductance component, which connects the first end of the emitting element and the first portion of the feeding element together; and a second lumped parameter element, including a second capacitive component or a second inductance component, which couples the second end of the emitting element and the second portion of the feeding element together.

8. The electronic apparatus according to claim 6, wherein a first gap through which the first portion and the emitting element electromagnetically couple is provided between an end of the first portion of the feeding element and the first end of the emitting element, and wherein a second gap through which the second portion and the emitting element electromagnetically couple is provided between an end of the second portion of the feeding element and the second end of the emitting element.

9. The electronic apparatus according to claim 6, wherein a length of an end of the first portion along the first end and a length of an end of the second portion along the second end are larger than a width of the feeding element at the feeding point.

10. The electronic apparatus according to claim 6, wherein a total of a length of the first portion of the feeding element along the first direction and a length of the second portion of the feeding element along the second direction is one half or less of an electrical length of a design wavelength.

11. A loop antenna comprising:

a substrate;

a feeding element including a first portion and a second portion which are provided on a first surface of the substrate, have electrical conductivity, are fed with electric power from a feeding point, the first portion extending from the feeding point in a first direction, the second portion extending from the feeding point in a second direction; and an emitting element which has electrical conductivity, is formed in a loop shape in such a manner that the emitting element surrounds the substrate along a surface perpendicular to the first surface, and includes a first end provided so as to electromagnetically couple to the first portion of the feeding element on the first surface and a second end provided so as to electromagnetically couple to the second portion of the feeding element on the first surface, a gap being disposed between the first end and the second end, wherein a length of an end of the first portion along the first end and a length of an end of the second portion along the second end are larger than a width of the feeding element at the feeding point.

* * * * *